US008476816B2

(12) United States Patent
Niessner

(10) Patent No.: US 8,476,816 B2
(45) Date of Patent: Jul. 2, 2013

(54) SPARK PLUG AND METHOD FOR MANUFACTURING A SPARK PLUG

(75) Inventor: Werner Niessner, Steinheim (DE)

(73) Assignee: Federal-Mogul Ignition GmbH, Wiesbaden (DE)

( * ) Notice: Subject to any disclaimer, the term of this patent is extended or adjusted under 35 U.S.C. 154(b) by 60 days.

(21) Appl. No.: 13/048,067

(22) Filed: Mar. 15, 2011

(65) Prior Publication Data

US 2011/0227472 A1 Sep. 22, 2011

(30) Foreign Application Priority Data

Mar. 17, 2010 (DE) ..... 10 2010 011 739

(51) Int. Cl.
*H01T 13/20* (2006.01)
*H01J 9/00* (2006.01)

(52) U.S. Cl.
USPC ..... 313/141; 313/144; 445/7; 445/35; 123/169 EL

(58) Field of Classification Search
None
See application file for complete search history.

(56) References Cited

U.S. PATENT DOCUMENTS 2,322,616 A 4/1942 Carson et al.
6,759,796 B2 7/2004 Klett et al.
2007/0228915 A1* 10/2007 Honda et al. ..... 313/143
2008/0238283 A1* 10/2008 Nakamura et al. ..... 313/143
2008/0284305 A1* 11/2008 Hoffman ..... 313/141
2008/0309214 A1 12/2008 Niessner et al.
2009/0102345 A1 4/2009 Hotta et al.
2011/0285270 A1* 11/2011 Tanaka et al. ..... 313/141
2011/0316408 A1* 12/2011 Suzuki ..... 313/141
2012/0001532 A1* 1/2012 Kure et al. ..... 313/118

FOREIGN PATENT DOCUMENTS

WO WO 2010/025054 A2 3/2010

* cited by examiner

*Primary Examiner* — Ashok Patel
(74) *Attorney, Agent, or Firm* — Reising Ethington P.C.

(57) ABSTRACT

A spark plug includes an inner conductor, an ignition tip connected to the inner conductor, an insulator surrounding the inner conductor and having a front end and a rear end, a spark plug body having a front end and a rear end, and at least one ground electrode connected to the front end of the spark plug body. The spark plug has a longitudinal direction extending parallel to the inner conductor. The spark plug body comprises a passage extending in the longitudinal direction and in which the insulator is disposed. A sleeve composed of metal is disposed between the insulator and the spark plug body. The sleeve is tightly connected to the insulator and the spark plug body and is referred to below as the "first sleeve". At least one second sleeve is disposed at a distance from the first sleeve) and, in fact, between the first sleeve and the rear end of the insulator. The second sleeve is connected to the insulator and touches the spark plug body in the passage thereof.

19 Claims, 2 Drawing Sheets

SPARK PLUG AND METHOD FOR MANUFACTURING A SPARK PLUG

The invention relates to a spark plug comprising an inner conductor, an ignition tip connected to the inner conductor, an insulator surrounding the inner conductor and having a front end and a rear end, a spark plug body having a front end and a rear end and at least one ground electrode connected to the front end of the spark plug body, wherein the spark plug has a longitudinal direction extending parallel to the inner conductor and the spark plug body has a passage extending in the longitudinal direction, into which passage the insulator is inserted, and wherein a metallic sleeve is disposed between the insulator and the spark plug body, which is tightly connected to the insulator and the spark plug body, and which is referred to hereinafter as the "first sleeve".

The invention furthermore relates to a method for manufacturing a spark plug comprising an inner conductor, an ignition tip connected to the inner conductor, an insulator surrounding the inner conductor and having a front end and a rear end, a spark plug body having a front end and a rear end and at least one ground electrode connected to the front end of the spark plug body, wherein the spark plug has a longitudinal direction extending parallel to the inner conductor and the spark plug body has a passage extending in the longitudinal direction, into which the insulator is placed, and wherein the insulator is tightly connected to the spark plug body by way of at least one metallic sleeve.

A spark plug of the initially described type and a method for manufacturing the spark plug are known from DE 12 89 360 A. In the case of the known method for manufacturing a spark plug, a prefabricated insulator comprising an inner conductor and an ignition tip is inserted together with a sleeve composed of soft metal into a passage in a spark plug body. Next, the sleeve is pressed together axially in that one end is retained securely on a base, and the other end of the sleeve is compressed by way of a plunger. The compression causes the sleeve to deform plastically, thereby securing the insulator in the spark plug body. At the same time, the sleeve provides a gas-tight seal between the insulator and the spark plug body. In the finished spark plug, the sleeve is the only connection between the insulator and the spark plug body.

When the insulator is inserted into the spark plug body using the known sleeve, the three parts, namely spark plug body, insulator, and sleeve, must be positioned and oriented relative to one another. At the same time the sleeve must be plastically deformed. In this type of manufacturing, it is often impossible to ensure exact positioning of the insulator within the spark plug body while the sleeve is being compressed. During compression the insulator may become offset relative to the spark plug body, and so the ignition tip is no longer centered in the spark plug body. In particular, during compression the insulator may "tilt" in the spark plug body, and so the insulator and spark plug body no longer extend exactly parallel to one another. Inaccurate positioning of the ignition tip may result. In all, with the known spark plug, relatively great inaccuracies result in regard to the positioning of the insulator in the spark plug body.

The problem addressed by the invention is that of creating a spark plug and a method for the manufacture thereof, in which the orientation and centering of the insulator in the spark plug body is improved without impairing the seal between the insulator and the spark plug body.

SUMMARY OF THE INVENTION

The problem is solved in the case of the spark plug of the initially described type in that at least one second sleeve is disposed at a distance from the first sleeve, between the first sleeve and the rear end of the insulator, wherein the second sleeve is connected to the insulator and touches the spark plug body in the passage thereof.

The problem is solved in the case of the method of the initially described type in that the at least one sleeve is fastened to the insulator and the insulator is then inserted into the spark plug body together with the at least one sleeve fastened thereto.

The terms "front end" and "rear end" are defined as follows: The "front end" of the spark plug or the spark plug body and the insulator is the end that is seated in the engine block and faces the combustion chamber of the engine when the spark plug is used. The ignition tip is disposed on the front end of the insulator. The "rear end" of the spark plug body faces away from the combustion chamber of the engine in the operating state. The "rear end" of the insulator is the end facing away from the ignition tip, which extends out of the spark plug body and is connected by way of the inner conductor to a supply line that delivers the ignition voltage for generating the ignition spark.

When a spark plug is formed by using two interspaced sleeves to position the insulator in the spark plug body, the insulator is centered in the spark plug body with greater accuracy. The insulator is guided and positioned at two points in the spark plug body. The two interspaced sleeves prevent the insulator from tilting relative to the spark plug body, thereby making it possible to ensure good parallelism between the insulator and the spark plug body. The position of the ignition tip relative to the ground electrode is determined in a highly precise manner as a result.

It is advantageous for the two sleeves to be separated from one another by the greatest possible distance. A large distance very effectively prevents the insulator from tilting in the spark plug body and enables the insulator to be centered in the spark plug body in a particularly precise manner. The first sleeve is therefore preferably disposed close to the front end of the spark plug body. The insulator has a tapering region on the front end thereof, which is referred to below as the "insulator base". To obtain the greatest possible distance between the two sleeves, it is advantageous for the first sleeve to be disposed in the vicinity of the insulator base. Preferably the first sleeve is disposed directly adjacent to the insulator base. A particularly large distance between the second sleeve and the first sleeve and, therefore, particularly accurate positioning of the insulator can be achieved when the second sleeve is disposed on the rear end of the spark plug body.

According to an advantageous embodiment of the invention, at least the first sleeve is brazed or soldered to the insulator. Brazing or soldering makes it possible to form a very secure connection between the insulator and the sleeve, thereby resulting in good positional accuracy and a secure sealing of the joint between the insulator and the sleeve against the gas pressure that is present in the combustion chamber of the engine. The insulator preferably has a substantially cylindrical outer contour for attaching the at least one sleeve.

It is advantageous for at least the first sleeve to have an interference fit with the spark plug body. By providing an interference fit between the sleeve and the spark plug body, very good centering of the insulator in the spark plug body is ensured. Simultaneously, a good seal of the joint between the sleeve and the spark plug body against the gas pressure present in the combustion chamber of the engine is achieved.

To ensure good, reliable function of the spark plug, it is sufficient for the first sleeve to be connected at the front end of the spark plug to the insulator and the spark plug body in a gas-tight manner. The second sleeve is used mainly to center the insulator in the spark plug body and does not need to have a tight connection with the insulator and the spark plug body. According to a particularly preferred embodiment of the invention, however, both sleeves are brazed or soldered to the insulator and have an interference fit with the spark plug body. The spark plug body preferably has a substantially cylindrical inner contour for accommodating the at least one sleeve in the region of the passage.

In an embodiment of the invention, it can be provided that at least one of the sleeves is composed of a metal having a coefficient of thermal expansion that is adapted to the material of the insulator. This embodiment has the advantage that the insulator and the sleeve expand uniformly under the influence of heat in the operating state, and the connection between sleeve and insulator is subjected to the least possible stress. This results in a connection between the sleeve and insulator that is gas-tight for the duration of a long service life. The insulator is advantageously composed of a ceramic. A smelt alloy that is manufactured on the basis of iron-nickel-cobalt and has a coefficient of thermal expansion that is adapted to the coefficient of thermal expansion of the ceramic is used preferably as the metal for the sleeve. Such alloys are manufactured e.g. by the company Vacuumschmelze GmbH & Co. KG in Hanau, DE.

It can be advantageous for the insulator and/or the spark plug body to have a shoulder for positioning one of the sleeves in the longitudinal direction of the spark plug. If a sleeve is brazed or soldered onto the insulator, for example, and is then pressed into the spark plug body, a shoulder on the insulator can position the sleeve in the longitudinal direction of the insulator during the brazing or soldering process. In the subsequent step of inward pressing, the shoulder on the insulator can support the sleeve and prevent excessive shear stress from acting on the brazed or soldered connection. A shoulder in the spark plug body can function as a stop for the sleeve when the insulator equipped with at least one sleeve is pressed in, thereby simplifying the pressing-in process.

According to a further embodiment of the invention, it is advantageous for the insulator and the inner conductor to be coextruded and sintered. As a result, the effort required to insert a separately manufactured inner connector into the insulator body and anchor it therein is omitted. Furthermore, leaky points between the inner conductor and the surrounding insulator body can therefore be prevented practically entirely. This advantage can be enhanced by composing the inner conductor of an electrically conductive ceramic.

The positioning and centering of the insulator in the spark plug body are improved by way of the method according to the invention for manufacturing a spark plug, in the case of which a sleeve is initially attached to the insulator, and then the insulator with the sleeve attached thereto is inserted into the spark plug body. In contrast to the prior art described initially, in the case of which three parts which are not interconnected must be handled and positioned, the method according to the invention provides that only two parts which are not yet interconnected need to be handled and possibly positioned relative to one another. In the first method step, the insulator and a sleeve are connected to one another. A second sleeve may also be connected to the insulator. Once one or both sleeves have been attached to the insulator, the insulator is inserted into the spark plug body. In the process of inserting the insulator, the insulator with the at least one sleeve attached thereto practically forms one component. The sleeve cannot lose its position relative to the insulator. A particularly good connection between the insulator and the sleeve is achieved by attaching the at least one sleeve to the insulator by brazing or soldering, preferably by active brazing.

Reducing the number of "loose" parts in a joining step makes it possible to reduce the inaccuracies that occur in this joining step and in the sum of all joining steps.

It is particularly advantageous for at least two sleeves to be attached to the insulator and, in fact, such that a first sleeve is attached to the insulator and sealed tightly to the insulator, and at least one second sleeve is attached to the insulator, and then the insulator is inserted into the spark plug body together with the sleeves attached thereto. Preferably the second sleeve is attached to the insulator at a distance from the first sleeve and, in fact, between the first sleeve and the rear end of the insulator. The second sleeve enables particularly good centering of the insulator in the spark plug body.

It is advantageous for at least the first sleeve to be attached to the insulator by brazing or soldering, preferably by active brazing, in order to obtain a connection between the sleeve and the insulator that is well-centered and simultaneously gas-tight.

To insert the insulator in the spark plug body, it can be advantageous to heat the spark plug body, slide the unheated insulator with the at least one sleeve attached thereto into the spark plug body, and to then cool the spark plug body, thereby enabling the spark plug body to become affixed by shrink-fitting onto the at least one sleeve connected to the insulator. Particularly preferably it is provided that the insulator is pressed into the spark plug body together with the at least one sleeve attached thereto. A pressing-in procedure without preheating results in a manufacturing method that can be carried out in a particularly simple, economical manner.

According to a further embodiment of the invention, it can be advantageous if, while the insulator is being inserted into the spark plug body, the position of the insulator relative to the spark plug body in the longitudinal direction of the spark plug is adjusted in accordance with a predetermined length. By selecting various predetermined lengths between the insulator and the spark plug body, the identical semi-finished products for the insulator, for the sleeve, and for the spark plug body can be used to manufacture different spark plugs which differ in regard to the heat ratings or spark positions thereof. The diversity of parts required for different types of spark plugs can be reduced as a result.

BRIEF DESCRIPTION OF THE DRAWINGS

Further details and advantages of the invention are explained in the following using an embodiment and with reference to the attached drawings. The features described can be made the subject matter of claims individually or in combination.

In the drawings.

DETAILED DESCRIPTION

Figure 1:
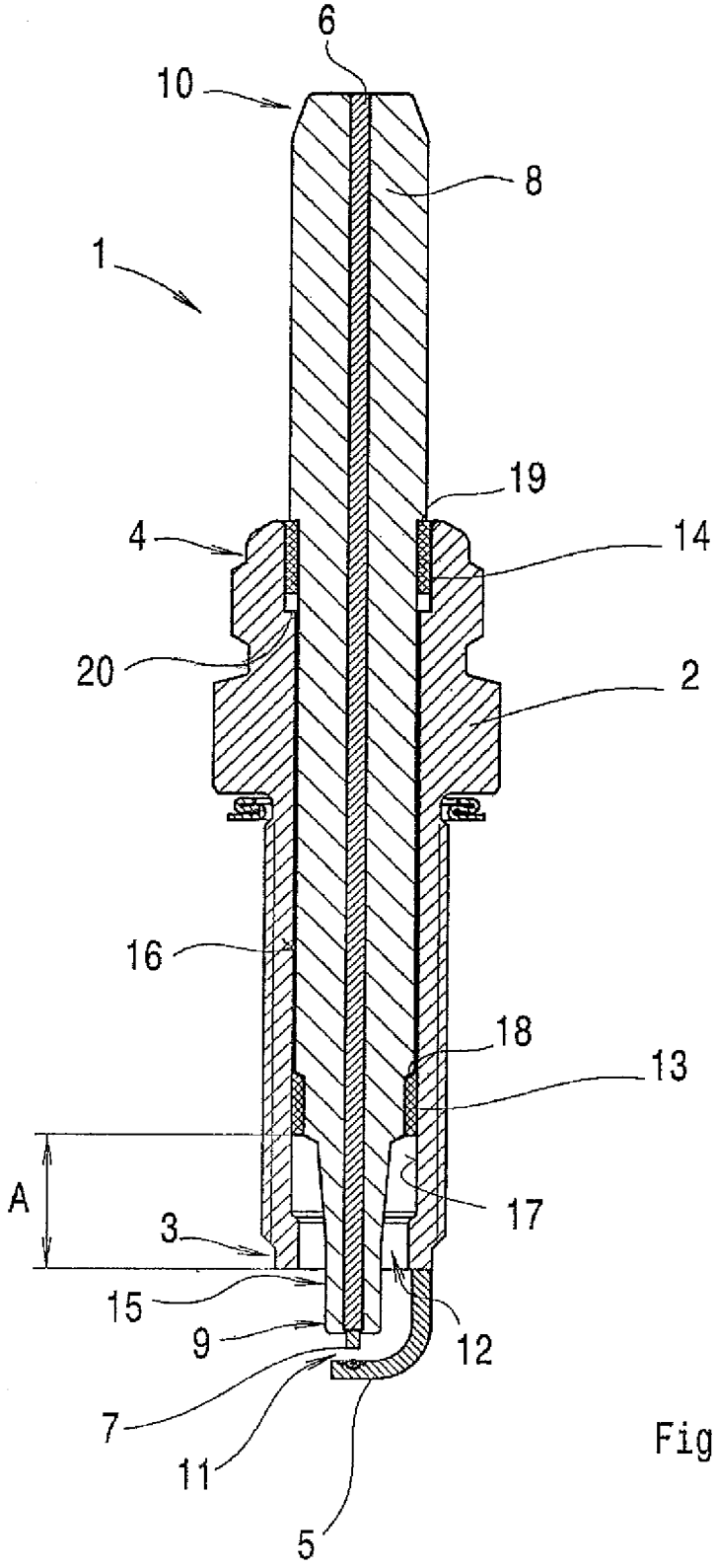
FIG. 1 shows a longitudinal sectional view of a spark plug according to the invention.
Figure 2:
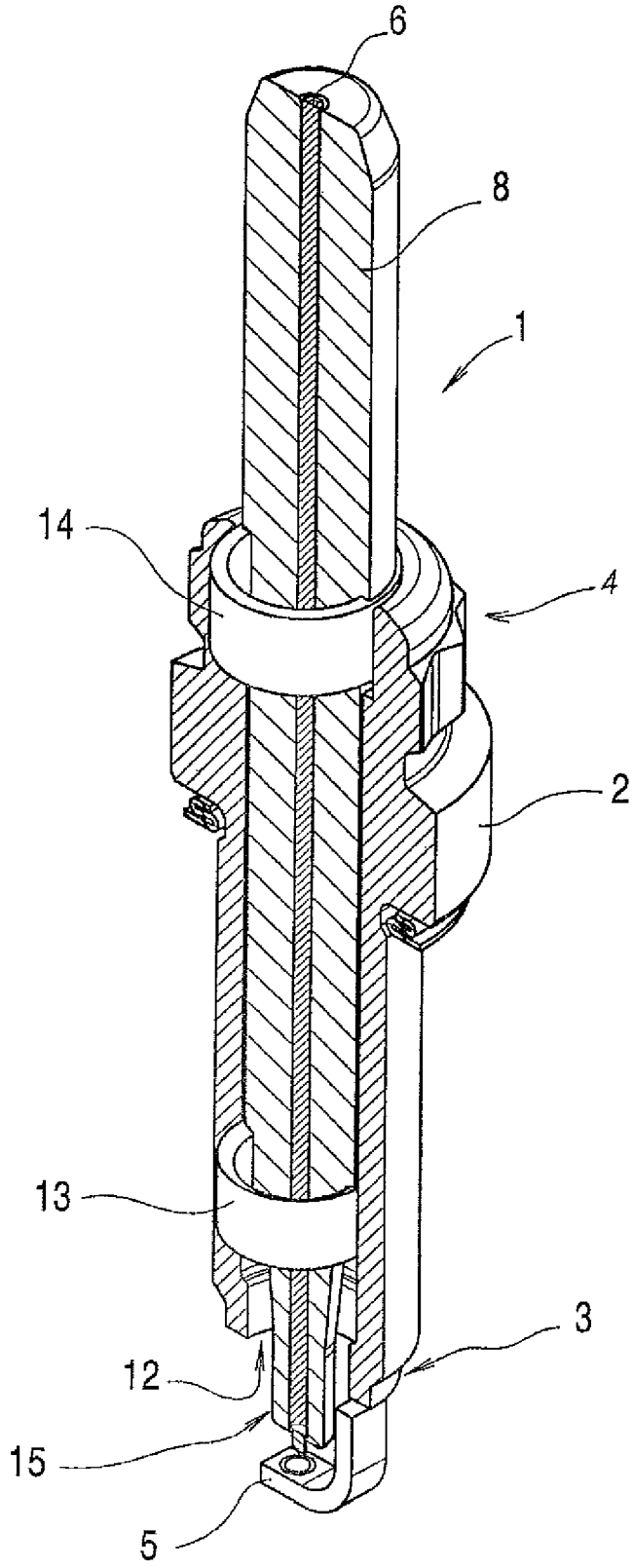
FIG. 2 shows the spark plug according to FIG. 1 in an isometric, partial cross-sectional view.

A spark plug 1 which contains a spark plug body 2 is shown in FIGS. 1 and 2. Spark plug 1, together with spark plug body 2 thereof, can be inserted into an engine block of an internal combustion engine in a manner known per se. Spark plug body 2 has a front end 3 and a rear end 4. A ground electrode 5 is disposed on front end 3 which extends into the engine in the operating state.

Spark plug 1 comprises an inner conductor 6 which is connected to an ignition tip 7. An insulator 8 is provided that encloses inner conductor 6 and comprises a front end 9 and a rear end 10. Ignition tip 7 is disposed on front end 9 of insulator 8 and forms, together with ground electrode 5, a spark gap 11 in which an ignition spark is produced in the operating state. Inner conductor 6 can be connected to a supply line, which is not depicted, at rear end 10 of the insulator in order to supply spark plug 1 with the necessary ignition voltage during operation. To ensure good contact of inner conductor 6 to the supply line, insulator 8 can be provided with metallization at rear end 10.

As shown, ignition tip 7 can be formed by inner conductor 6 extending out of insulator 8 by a slight extent. Depending on the requirement on spark plug 1, ignition tip 7 can also be formed by an additional part which is inserted into front end 9 of insulator 8 and is connected to inner conductor 6 in an electrically conductive manner. The inserted part preferably contains a precious metal ignition tip to ensure that the spark plug has a long service life.

Spark plug body 2 has a passage 12 which extends in the longitudinal direction of spark plug 1. The "longitudinal direction" is understood to be the direction that extends parallel to inner conductor 6. Insulator 8 is disposed in passage 12. Two sleeves 13 and 14 composed of metal are provided, which are disposed between insulator 8 and spark plug body 2. Sleeve 13 is disposed in the region of front end 3 of spark plug body 2 and is referred to below as the "first sleeve". First sleeve 13 is tightly connected to insulator 8 and spark plug body 2 to prevent pressurized gasses from escaping from the combustion chamber of the engine in the operating state.

Second sleeve 14 is disposed at a distance from first sleeve 13 in a region between first sleeve 13 and rear end 10 of insulator 8. Second sleeve 14 is connected to insulator 8 and touches spark plug body 2 in passage 2 thereof. The two sleeves 13, 14 ensure that insulator 8 is well positioned and centered in spark plug body 2.

Insulator 8 has a tapering region on front end 9 thereof, which is referred to below as insulator base 15. First sleeve 13 is disposed in the vicinity of insulator base 15. Second sleeve 14 is disposed on rear end 4 of spark plug body 2. As a result, the greatest possible distance between the two sleeves 13, 14 can be achieved, which enables particularly good centering of insulator 8 in spark plug body 2 to be achieved.

Spark plug 1 is manufacturing using a method in which sleeves 13, 14 are attached to insulator 8, and insulator 8 with sleeves 13, 14 attached thereto is then inserted into spark plug body 2. It is advantageous for sleeves 13, 14 to be attached to insulator 8 by brazing or soldering. Active brazing is particularly suitable for use to connect an insulator 8 composed of ceramic to a metallic sleeve. In active brazing a brazing alloy is used that contains components such as titanium that react with the surface of the ceramic sleeve and is thereby capable of wetting it.

Insulator 8, with sleeves 13, 14 attached thereto, which is to be inserted into spark plug body 2 can be affixed in spark plug body 2 in different ways. Preferably an interference fit is provided between sleeves 13, 14 and spark plug body 2, and insulator 8 is inserted by being pressed in. When insulator 8 is pressed in, the position of insulator 8 relative to spark plug body 2 in the longitudinal direction of spark plug 1 can be set in accordance with a predetermined dimension A. Dimension A is also referred to as "press-in depth" and is preferably defined by the distance of first sleeve 13 from front end 3 of spark plug body 2. Given that press-in depth A can be varied, it is possible to insert selectively different insulators 8, which differ e.g. by the shape of insulator base 15, into a single spark plug body 2. Different spark plugs 1 which differ in terms of the heat rating or spark position thereof can therefore be manufactured using a very low diversity of parts.

For the manufacturing method described, it is sufficient for outer wall 16 of insulator 8 and inner wall 17 of passage 12 in spark plug body 2 to be cylindrical. Projections or shoulders are not required. If cylindrical outer wall 16 is smooth, the distance between first sleeve 13 and ignition tip 7 can be varied before soldering or brazing. Without making geometric changes to insulator 8 or spark plug body 2, spark plugs can therefore be manufactured with different heat ratings since the heat rating is determined mainly by the heat that develops on ignition tip 7 and insulator base 15 during operation being diverted by way of first sleeve 13.

According to a preferred embodiment, a shoulder 18 for sleeve 13, and a shoulder 19 for sleeve 14 are provided on insulator 8. Shoulders 18 and 19 position sleeves 13 and 14 when being brazed or soldered onto insulator 8. During the pressing-in step, shoulders 18, 19 prevent the brazed or soldered connection from becoming damaged by impermissibly high shear stress. A shoulder 20 can be provided in spark plug body 2. Shoulder 20 forms a stop for sleeve 14 when insulator 8 with sleeves 13, 14 attached thereto is pressed in. In this case, press-in depth A does not need to be measured or monitored separately since correct dimension A is ensured when sleeve 14 comes to rest on shoulder 20.

Inner conductor 6 in insulator 8 can be manufactured in a manner known per se by way of glass sealing. An interference-suppression resistor, which is not depicted, can be integrated into inner conductor 6. For a spark plug 1 according to the invention, the outer contour, in particular outer wall 16, of insulator 8 is primarily cylindrical. Therefore, it is particularly preferable for insulator 8 and inner conductor 6 to be coextruded and then sintered together. In that case, inner conductor 6 is preferably made of an electrically conductive ceramic.

As an alternative to the pressing in of insulator 8, it can also be advantageous, in particular when very strong retaining forces are required in spark plug body 2, for spark plug body 2 to be heated, unheated insulator 8 with sleeves 13, 14 attached thereto to be slid into passage 12, and for spark plug body 2 to then be cooled, thereby enabling spark plug body 2 to become affixed onto sleeves 13, 14 by way of shrink-fitting.

REFERENCE CHARACTERS

1 Spark plug
2 Spark plug body
3 Front end of spark plug body
4 Rear end of spark plug body
5 Ground electrode
6 Inner conductor
7 Ignition tip
8 Insulator
9 Front end of insulator
10 Rear end of insulator
11 Ignition gap
12 Passage
13 Sleeve (first)
14 Sleeve (second)
15 Insulator base
16 Outer wall of insulator
17 Inner wall of passage
18 Shoulder for sleeve 13 on the insulator
19 Shoulder for sleeve 14 on the insulator
20 Shoulder in the spark plug body
A Press-in depth, length

What is claimed is:

1. A spark plug comprising:

an inner conductor;

an ignition tip connected to the inner conductor;

an insulator surrounding the inner conductor and having a front end and a rear end;

a spark plug body having a front end and a rear end;

at least one ground electrode connected to the front end of the spark plug body, the spark plug having a longitudinal direction extending parallel to the inner conductor and the spark plug body has a passage extending in the longitudinal direction, the insulator being disposed in the passage;

a first sleeve disposed between the insulator and the spark plug body; and a second sleeve disposed between the insulator and the spark plug body and being spaced from the first sleeve in the longitudinal direction, wherein at least the first sleeve is brazed or soldered to the insulator and forms a gas-tight connection with the insulator that prevents pressurized gases from escaping a combustion chamber.

2. The spark plug according to claim 1, wherein the insulator has a tapering region with an insulator base on the front end thereof, and the first sleeve is disposed in the vicinity of the insulator base.

3. The spark plug according to claim 2, wherein the first sleeve is disposed adjacent the insulator base.

4. The spark plug according to claim 1, wherein the second sleeve is disposed on the rear end of the spark plug body.

5. The spark plug of claim 1, wherein at least one of the first sleeve or the second sleeve is a metallic sleeve and includes an iron-nickel-cobalt alloy.

6. The spark plug according to claim 1, wherein at least the first sleeve has an interference fit with the spark plug body.

7. The spark plug according to claim 1, wherein at least one of the sleeves is composed of a metal having a coefficient of thermal expansion adapted to the material of the insulator.

8. The spark plug according to claim 1, wherein the insulator and/or the spark plug body comprises a shoulder for positioning one of the sleeves in the longitudinal direction of the spark plug.

9. The spark plug according to claim 1, wherein the insulator and the inner conductor are coextruded and sintered.

10. The spark plug according to claim 9, wherein the inner conductor is composed of an electrically conductive ceramic.

11. A method for manufacturing a spark plug comprising an inner conductor, an ignition tip connected to the inner conductor, an insulator surrounding the inner conductor and having a front end and a rear end, a spark plug body having a front end and a rear end and at least one ground electrode connected to the front end of the spark plug body, wherein the spark plug has a longitudinal direction extending parallel to the inner conductor and the spark plug body has a passage extending in the longitudinal direction, wherein the method comprises the steps of:

attaching at least one metallic sleeve to the insulator by soldering or brazing; and inserting the insulator with the at least one attached sleeve into the spark plug body passage so that a soldered or brazed connection exists between the insulator and the at least one sleeve and an interference fit exists between the at least one sleeve and the spark plug body.

12. The method according to claim 11, in which the brazing is selected to be an active brazing.

13. The method according to claim 11, wherein the at least one sleeve is a first sleeve attached to the insulator and tightly connected to the insulator, at least one second sleeve is attached to the insulator, and subsequently the insulator with the sleeves attached thereto is inserted into the spark plug body.

14. The method according to claim 13, wherein the second sleeve is attached to the insulator at a distance from the first sleeve.

15. The method according to claim 13, wherein at least the first sleeve is attached to the insulator by brazing or soldering.

16. The method according to claim 15, in which the brazing is selected to be an active brazing.

17. The method according to claim 11, wherein the insulator with the at least one sleeve attached thereto is pressed into the spark plug body.

18. The method according to claim 11, wherein the spark plug body is heated, the insulator is an unheated insulator with the at least one sleeve attached thereto and is inserted into the spark plug body, and the spark plug body is then cooled, thereby enabling the spark plug body to become affixed by way of shrink-fitting onto the at least one sleeve connected to the insulator.

19. The method according to claim 11, wherein when the insulator is inserted into the spark plug body, the position of the insulator relative to the spark plug body in the longitudinal direction of the spark plug is set in accordance with a predetermined length.

* * * * *